US006918661B2

(12) United States Patent
Ito

(10) Patent No.: US 6,918,661 B2
(45) Date of Patent: Jul. 19, 2005

(54) INK-JET RECORDING HEAD AND METHOD FOR PRODUCING THE SAME

(75) Inventor: Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 105 days.

(21) Appl. No.: 10/463,475

(22) Filed: Jun. 18, 2003

(65) Prior Publication Data

US 2004/0001125 A1 Jan. 1, 2004

(30) Foreign Application Priority Data

Jun. 27, 2002 (JP) ..... 2002-187595

(51) Int. Cl.[7] ..... B41J 2/045
(52) U.S. Cl. ..... 347/71
(58) Field of Search ..... 347/71, 70, 68, 347/54, 69, 92, 50, 40, 20, 44, 47, 27, 63; 399/261; 361/700; 310/328–330; 29/890.1

(56) References Cited

U.S. PATENT DOCUMENTS 4,385,304 A 5/1983 Sniderman
4,387,383 A 6/1983 Sayko
4,578,686 A 3/1986 Vollert
2001/0020968 A1 9/2001 Isono et al.

FOREIGN PATENT DOCUMENTS

EP 0 431 692 A1 6/1991
EP 0 486 256 A2 5/1992
JP A 55-84677 6/1980
JP 2001-246744 9/2001

*Primary Examiner*—Raquel Yvette Gordon
(74) *Attorney, Agent, or Firm*—Oliff & Berridge, PLC

(57) ABSTRACT

A cavity unit, which has an increased/decreased number of nozzles (pressure chambers), can be easily manufactured by merely stacking minimum plate units each comprising common elements including a nozzle, a pressure chamber, and a common ink chamber. An arbitrary number of first plates 40, each of which includes common elements of a nozzle 43, a pressure chamber 44, a common ink chamber 42, an ink supply flow passage 45, and an ink flow passage 46, are stacked and joined in a direction of arrangement of the pressure chambers 44. A piezoelectric actuator 2 is placed thereon and joined so that portions of the pressure chambers 44, which are open on first side end surfaces of the first plates 40, are covered therewith.

17 Claims, 10 Drawing Sheets

INK-JET RECORDING HEAD AND METHOD FOR PRODUCING THE SAME

BACKGROUND OF THE INVENTION

1. Field of the Invention

The present invention relates to a structure of an ink-jet printer head such as those based on the piezoelectric system.

2. Description of the Related Art

A piezoelectric ink-jet printer head of the on-demand type concerning the conventional technique is described in Japanese Patent Application Laid-open No. 2001-246744, corresponding to U.S. Patent Application Publication No. U.S. 2001/0020968 A1. This patent document discloses the construction of a cavity unit obtained by stacking a nozzle plate which includes a plurality of nozzles arranged in an array form, a base plate which includes pressure chambers each disposed for each of the nozzles and arranged in an array form in the direction of the array of the nozzles, a manifold plate which is provided with a manifold chamber to serve as a common ink chamber for supplementing the ink to the respective pressure chambers after storing the ink supplied from an ink supply source, and a spacer plate which is interposed between the manifold plate and the base plate. In this arrangement, ink supply flow passages, which make the communication from the respective pressure chambers to the corresponding nozzles, are formed to make the penetration through the manifold plate and the spacer plate. Further, ink flow passages, which make the communication from the manifold chamber to the respective pressure chambers, are formed for the spacer plate. The disclosed structure includes a piezoelectric actuator which is stacked on the upper surface of the base plate and which has activating sections capable of being selectively driven for each of the pressure chambers to jet the ink.

In the cavity unit constructed as described above, a predetermined number of nozzles are formed at predetermined spacing distances to penetrate through the plate thickness of the thin metal plate (plate). The ink supply flow passages and the ink flow passages are formed for the other plates (manifold plate and spacer plate) as well. The manifold plate has the manifold chamber which occupies a large range, which makes it possible to supply the ink to all of the pressure chambers, and which is formed to make the penetration through the plate thickness as well. The following problem arises because the plates as described above are stacked.

That is, it is necessary that the respective plates are previously bored, for example, with the predetermined numbers of the nozzles, the pressure chambers, and the ink flow passages for making the communication therebetween at the predetermined spacing distances. When a product, which has an increased or decreased number of nozzles (pressure chambers), is produced, it is necessary to manufacture the product by determining the size of the plates from the beginning corresponding thereto. Therefore, it has been impossible to adopt manufacturing steps capable of immediately responding to any arbitrary change of the number of nozzles (number of pressure chambers).

In the conventional technique, the plurality of plates as described above are stacked and joined. Therefore, the following problem has arisen. That is, any stacking deviation tends to occur during the operation. In particular, it is difficult to make the smooth communication of the ink supply flow passages having small diameters over the range from the pressure chambers to the nozzles.

SUMMARY OF THE INVENTION

The present invention has been made in order to solve the problems involved in the conventional technique as described above, an object of which is to provide an ink-jet recording head in which pressure chambers and a common ink chamber are formed by stacking a plurality of plates in a direction of arrangement of the pressure chambers to stack the plates of a corresponding number depending on a desired number of nozzles so that the response can be made immediately to the increase or decrease in number of nozzles (number of pressure chambers) with ease, and the ink flow performance is not varied even by the stacking operation.

According to a first aspect of the present invention, there is provided an ink-jet recording head comprising:

a cavity unit which has a plurality of nozzles, a plurality of pressure chambers which are communicated with the plurality of nozzles respectively and which are arranged in a direction, and a common ink chamber which extends in the direction of arrangement of the plurality of pressure chambers and which are communicated with the plurality of pressure chambers; and an actuator which deforms the respective pressure chambers, wherein:

the cavity unit includes a plurality of stacked plates, and each of the plates has a nozzle which constitutes the plurality of nozzles, a pressure chamber which is communicated with the nozzle and which constitutes the plurality of pressure chambers, and an opening which is communicated with the pressure chamber and which defines the common ink chamber.

The plate, which constitutes the cavity unit of the recording head of the present invention, basically has one nozzle and one pressure chamber communicated therewith. Accordingly, one plate provides one ink channel. Therefore, the structure of the cavity unit is extremely simple, and it is possible to decrease the types of parts and the types of machining processes. For this reason, it is possible to lower the production cost. Further, a variety of recording heads having different numbers of nozzles (pressure chambers) can be produced by changing only the number of the stacked plates. Therefore, the flexibility or adaptability is improved at the production site for manufacturing the recording head, and the productivity of the recording head is improved. Further, there is no dispersion or unevenness in the ink-jet performance such as the jetting performance among the plurality of nozzles, and it is possible to manufacture the ink-jet recording head having the stable performance. Even when the plate thickness of each of the plates is thin, the entire cavity unit, which is assembled so that the large number of nozzles (pressure chambers) are arranged in array, can be made compact while increasing the rigidity thereof.

In the ink-jet recording head of the present invention, the plurality of plates may be stacked in the direction of arrangement of the pressure chambers. The common ink chamber may extend in the direction of arrangement of the pressure chambers.

According to a first specified structure of the recording head, the respective plates may be first plates each having the pressure chamber and the opening which are formed penetratingly in a thickness direction of the plate, and the ink-jet recording head may further comprise a plurality of second plates each having an opening which defines the common ink chamber and which is formed penetratingly in the thickness direction of the plate. In this structure, the first plates and the second plates may be alternately stacked so that the openings of the first plates and the openings of the second plates are communicated with each other. In the case of this structure, the minimum unit of the ink channel is constructed by the combination of the first plate which is provided with the nozzle, the pressure chamber and the opening for the common ink chamber, and the second plate which is provided with only the opening for the common ink chamber. A part of the pressure chamber of the first plate may be defined by the second plate.

An ink supply flow passage for communicating the pressure chamber with the nozzle and an ink flow passage for communicating the pressure chamber with the opening may be formed penetratingly through the plate in the thickness direction of the plate. When each of the first plates has the respective openings of the pressure chamber, the nozzle, and the common ink chamber as well as the ink supply flow passage and the ink flow passage communicating therewith which are previously formed in an integrated manner as described above, it is possible to easily manufacture the cavity unit having a necessary number of nozzles by merely stacking a necessary number of plates by abutting the second plates against the wide width surfaces (surfaces perpendicular to the direction of arrangement of the pressure chambers) of the first plates. The nozzle pitch can be adjusted with ease by merely changing each of the plate thicknesses of the first plate and the second plate. Further, even when the stacking operation is performed, there is no fluctuation of the performance of the flow of the ink through the ink supply flow passage and the ink flow passage each having a small cross-sectional area.

The ink-jet recording head may further comprise an end plate which seals at least an end of the common ink chamber, the end plate being disposed at an end surface of a stack constructed by the first plates and the second plates in a stacking direction. According to this structure, it is easy to form the common ink chamber.

According to a second specified structure, the plate may be provided with an ink supply flow passage for communicating the pressure chamber with the nozzle and an ink flow passage for communicating the pressure chamber with the opening, the opening may be formed penetratingly in a thickness direction of the plate, and the pressure chamber, the ink supply flow passage, and the ink flow passage may be formed as recesses in the thickness direction of the plate on a surface perpendicular to the direction of arrangement of the pressure chambers. Also in this structure, it is possible to easily obtain the cavity unit having a necessary number of nozzles (pressure chambers) by merely stacking a necessary number of plates having the identical shape (i.e., the minimum plate units each comprising the common elements of the nozzle, the pressure chamber, and the opening for the common ink chamber). In this structure, the second plates are unnecessary, as compared with the first specified structure. Therefore, it is possible to further decrease the types of parts, and it is possible to further reduce the production cost of the cavity units having various numbers of nozzles.

In the second specified structure, a side portion of the pressure chamber of each of the plates may be covered with the adjoining plate, and an upper portion of the pressure chamber of each of the plates may be covered with the actuator. According to this structure, it is possible to decrease the number of parts of the cavity unit and/or the actuator, and it is possible to make the recording head more compact.

In the recording head of the present invention, the actuator may have activating sections each of which is selectively drivable for each of the pressure chambers and which are arranged in parallel to the arrangement of the pressure chambers. When the activating section of the actuator is opposed to the opening of the pressure chamber, it is possible to enhance the operation efficiency of the actuator for jetting the ink contained in the pressure chamber.

According to a second aspect of the present invention, there is provided a method for producing an ink-jet recording head comprising a cavity unit which has a plurality of nozzles, a plurality of pressure chambers which are communicated with the plurality of nozzles respectively and which are arranged in a direction, and a common ink chamber which extends in the direction of arrangement of the plurality of pressure chambers and which are communicated with the plurality of pressure chambers; and an actuator which deforms the respective pressure chambers, the method comprising providing a plurality of plates each having a nozzle which constitutes the plurality of nozzles, a pressure chamber which is communicated with the nozzle and which constitutes the plurality of pressure chambers, and an opening which is communicated with the pressure chamber and which defines the common ink chamber; assembling the cavity unit by stacking the plurality of plates so that the openings of the plurality of plates are communicated with each other in the direction of arrangement of the pressure chambers; and attaching the actuator to the cavity unit. According to this method, the cavity unit, which has a necessary number of nozzles (pressure chambers), can be obtained with ease by merely staking a necessary number of plates having the identical shape (i.e., the minimum plate units comprising the common elements of the nozzle, the pressure chamber, and the opening for the common ink chamber). Therefore, it is possible to decrease the types of parts, and it is possible to reduce the production cost of the cavity units having various numbers of nozzles.

In the production method of the present invention, the respective plates may be first plates each having the pressure chamber and the opening which are formed penetratingly in a thickness direction of the plate, and the first plates and second plates each having an opening which defines the common ink chamber and which is formed penetratingly in the thickness direction of the plate may be alternately stacked so that the openings of the first plates and the openings of the second plates are communicated with each other. In this procedure, a part of the pressure chamber of the first plate may be defined by the second plate. Further, an ink supply flow passage for communicating the pressure chamber with the nozzle and an ink flow passage for communicating the pressure chamber with the opening may be formed penetratingly through the plate in the thickness direction of the plate. Further, the production method may further comprise providing an end plate which seals at least an end of the common ink chamber, at an end surface of a stack constructed by the first plates and the second plates in a stacking direction.

The plate to be used for this production method may be provided with an ink supply flow passage for communicating the pressure chamber with the nozzle and an ink flow passage for communicating the pressure chamber with the opening, the opening may be formed penetratingly in a thickness direction of the plate, and the pressure chamber, the ink supply flow passage, and the ink flow passage may be formed as recesses in the thickness direction of the plate on a surface perpendicular to the direction of arrangement of the pressure chambers. In this procedure, the plurality of plates may be stacked so that a side portion of the pressure chamber of each of the plates is covered with the adjoining plate, and the actuator may be attached to the cavity unit so that an upper portion of the pressure chamber of each of the plates is covered with the actuator.

DESCRIPTION OF THE PREFERRED EMBODIMENTS

Figure 1:
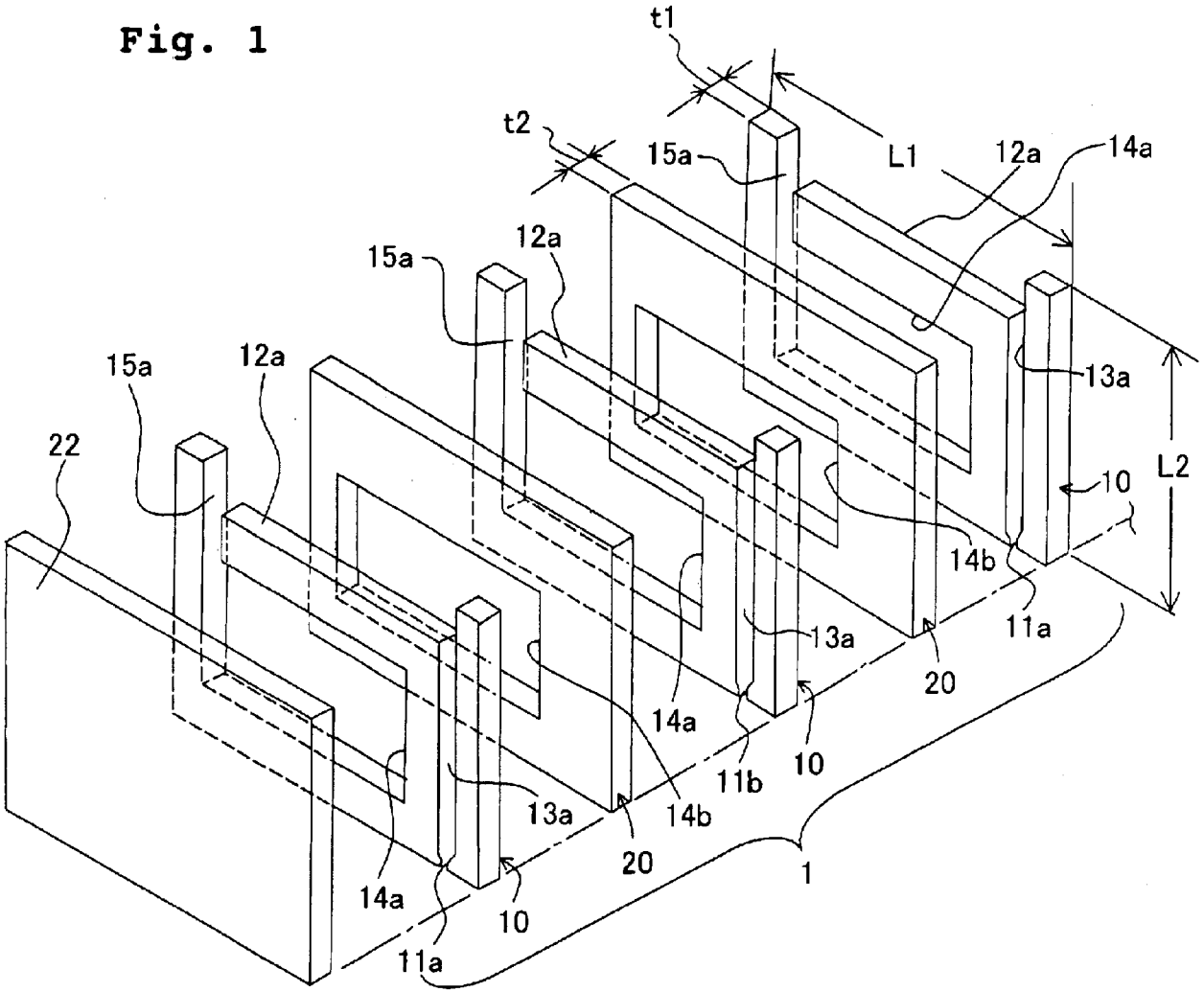
FIG. 1 shows a perspective view illustrating shapes of respective openings of first plates and second plates according to a first embodiment of the present invention.

An explanation will be made below with reference to the drawings about embodiments of the piezoelectric ink-jet recording head in which the present invention is embodied. FIGS. 1 to 6 show a first embodiment of the present invention. In the drawings, a cavity unit 1 comprises a plurality of nozzles 11 which are arranged in array in the same manner as in those known of this type, a plurality of pressure chambers 12 which are disposed in array in parallel to the nozzles 11, and a common ink chamber 14 which extends in a direction of arrangement of the pressure chambers 12. A flexible flat cable 4 (see FIG. 6) is overlapped and joined with an adhesive on the upper surface of a plate-shaped piezoelectric actuator 2 (see FIG. 6) to be joined to the cavity unit 1 in order to make the connection to an external apparatus. The ink is jetted downwardly from the nozzles 11 which are open on the lower surface side of the cavity unit 1.

As shown in FIGS. 1 to 4, the cavity unit 1 according to the first embodiment comprises a plurality of plates 10, 20 which are stacked in the direction of arrangement of the pressure chambers 12. As for each of the plates 10, 20, the surface, which is perpendicular to the direction of arrangement of the pressure chambers 12, serves as the surface as the so-called plate, i.e., the wide width surface, and the plate thickness extends in the direction of arrangement of the pressure chambers 12. The wide width surface of each of the plates 10, 20 has the width L1 which is larger than the length of the pressure chamber 12 and the height L2 which corresponds to the height ranging from the top of the pressure chamber 12 to the nozzle 11. The plates of one type (first plates) 10 have the plate thickness t1 corresponding to the width (width in the direction of arrangement) of the pressure chamber 12, and the plates of the other type (second plates) 20 have the plate thickness t2 corresponding to the spacing distance for separating the adjoining pressure chambers 12 from each other.

The both types of plates 10, 20 are alternately stacked and joined by applying an adhesive (not shown) to their wide width surfaces so that the wide width surfaces (surfaces perpendicular to the direction of arrangement of the pressure chambers 12) are faced to one another. An end plate 22 is joined, for example, with an adhesive to the both end surfaces (wide width surfaces) of the both types of plates 10, 20 in the stacking direction to cover the entire wide width surfaces of the stacked plates 10, 20 disposed at the ends (see FIG. 2).

The arrangement will be explained in more detail below. The first plate 10, which is substantially rectangular as viewed in plan view, has an opening 11*a* to form one nozzle 11, an opening 12*a* to form the pressure chamber 12 corresponding to the nozzle 11, an opening 13*a* to form the ink supply flow passage 13 communicating from the pressure chamber 12 to the nozzle 11, an opening 14*a* to form the common ink chamber 14, and an opening 15*a* to form the ink flow passage 15 communicating from the common ink chamber 14 to the pressure chamber 12, the openings being connected to one another on the wide width surface of the first plate 10 and penetrating in the plate thickness direction.

The opening 12*a* to form the pressure chamber 12 is formed in a state in which the opening 12*a* is open in the length direction to the outside from the outer edge of the plate 10 in the direction of the widthwise size L1 of the plate 10. The opening 12*a* has a depth as the pressure chamber 12 toward the inside of the plate 10. The opening 14*a* to form the common ink chamber 14 is arranged while being surrounded by the entire circumference of the plate 10 on the side of the opening 11*a* to form the nozzle 11 as compared with the opening 12*a*. The opening 14*a* is formed to have a cross-sectional area which is as large as possible while remaining the minimum widths of partition walls with respect to the opening 12*a*, the opening 13*a* to form the ink supply flow passage 13, and the outer circumference of the plate 10.

The widthwise size H2 of the opening 15*a* to form the ink flow passage 15 is designed to be smaller than the widthwise size H1 of the opening 13*a* to form the ink supply flow passage 13. Accordingly, the flow rate resistance of the ink is increased on the side of the ink flow passage 15 when the volume of the pressure chamber 12 is reduced in accordance with the operation of the piezoelectric actuator 2 to extrude the ink contained in the pressure chamber 12 simultaneously toward the nozzle 11 (ink supply flow passage 13) and the common ink chamber 14 (ink flow passage 15). Thus, the efficiency for jetting the ink from the nozzle 11 is enhanced.

The opening 11*a* to form the nozzle 11 is open on the first end surface of the first plate 10. An opening 14*b*, which has approximately the same shape as viewed in plan view (for example, the substantially rectangular shape in this embodiment) as that of the opening 14*a* to form the common ink chamber 14 of the first plate 10, is formed to penetrate through the second plate 20 in the plate thickness direction of the second plate 20.

Figure 4:
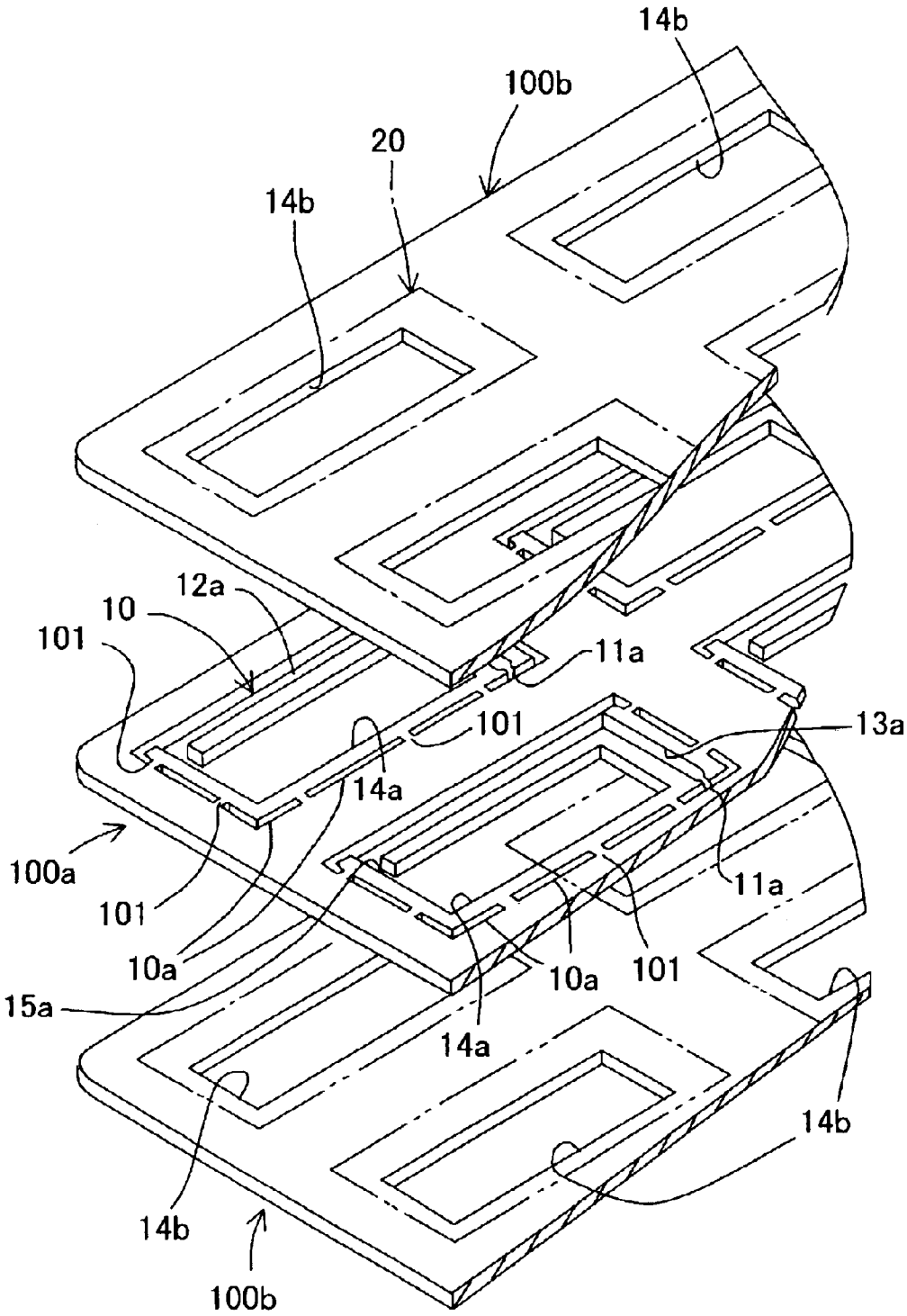
FIG. 4 shows a magnified partial perspective view illustrating the assembling of the cavity unit.

An explanation will be made about an assembling method to obtain the stacked structure as described above. As shown in FIG. 4, areas for forming the first plates 10 (having substantially rectangular shapes as viewed in plan view in this embodiment) are secured at predetermined spacing distances in a matrix form in the vertical and horizontal directions on each of first lead frames 100*a* as a material corresponding to the first plates 10. The opening 11*a* to form the nozzle 11, the opening 13*a* to form the ink supply flow passage 13, the opening 12*a* to form the pressure chamber 12, the opening 15*a* to form the ink flow passage 15, and the opening 14*a* to form the common ink chamber 14 are formed in each of the formation areas to make the penetration through the plate thickness by means of, for example, the punching out, the laser processing, the plasma processing, or the etching processing. In this situation, as shown in FIG. 4, intermittent boundary lines 10*a* are bored to surround the formation areas of the first lead frame 100*a*. That is, the connection is made with a plurality of tie bars 101 disposed at appropriate spacing distances to bridge the boundary lines 10*a* which partition the outside and the inside of the formation areas. Accordingly, the plate portions disposed in the formation areas are prevented from disengagement.

Areas for forming the second plates 20 (having substantially rectangular shapes as viewed in plan view in this embodiment) are secured at predetermined spacing distances in a matrix form in the vertical and horizontal directions on each of second lead frames 100*b* as a material corresponding to the second plates 20. The opening 14*b* to form the common ink chamber 14 is formed in each of the formation areas to make the penetration through the plate thickness by means of, for example, the punching out, the laser processing, or the plasma processing in the same manner as described above. In FIG. 4, portions surrounded by dashed lines are the formation areas for the second plates 20.

Figure 2:
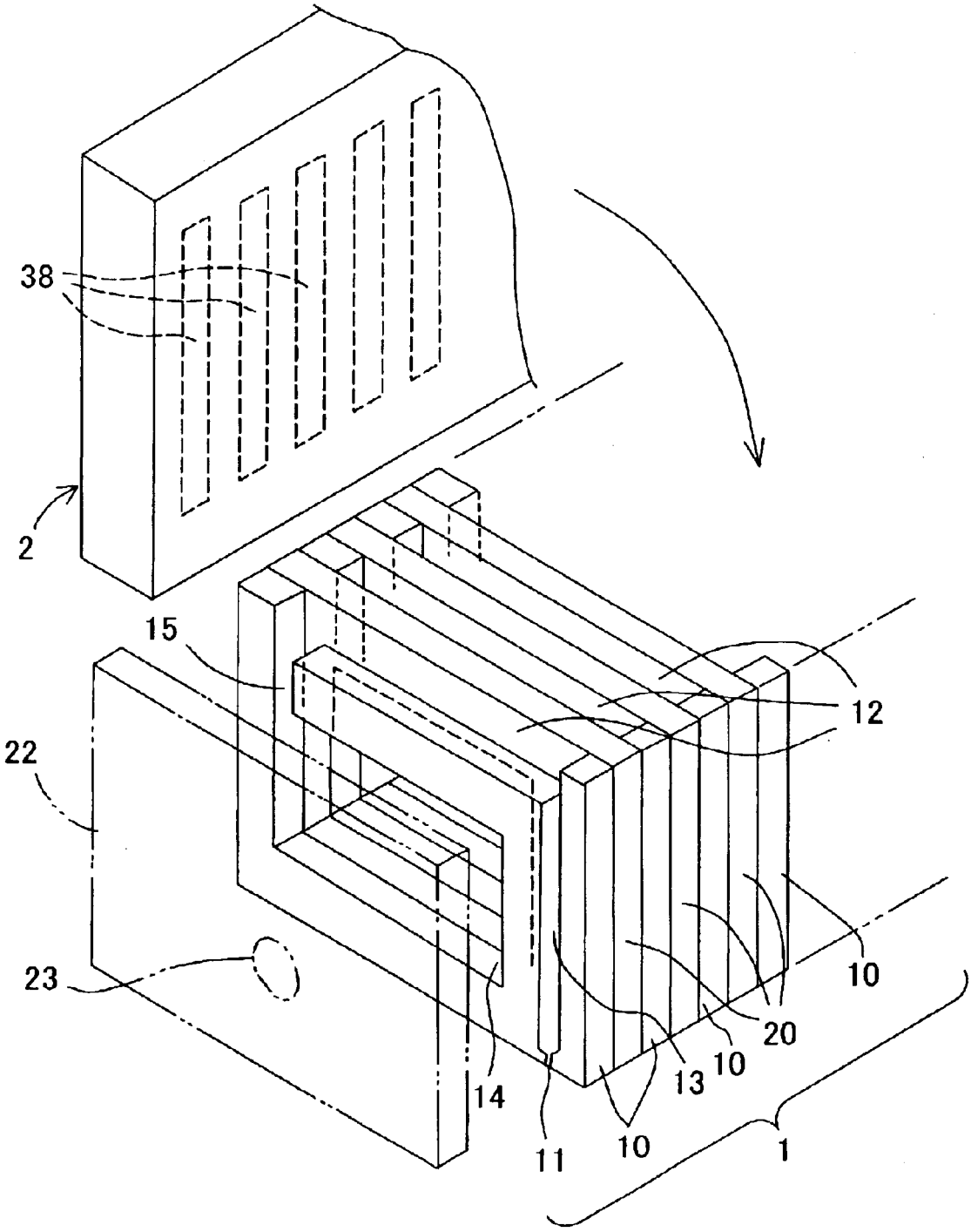
FIG. 2 shows a perspective view illustrating a cavity unit constructed by alternately stacking the first plates and the second plates according to the first embodiment.
Figure 3:
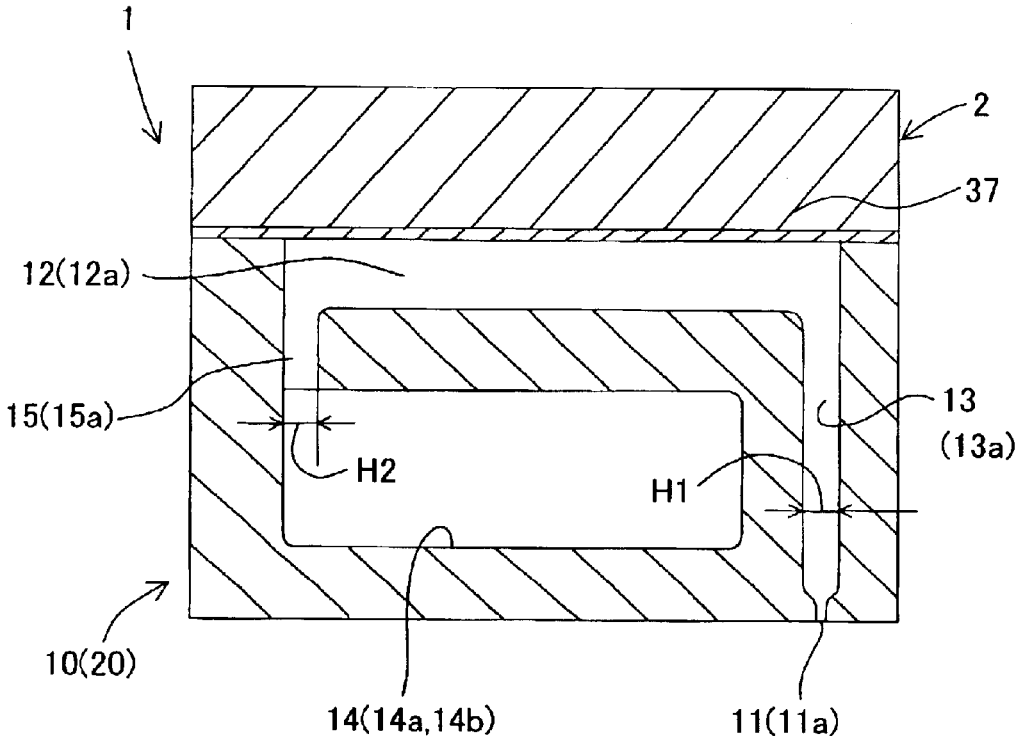
FIG. 3 shows a magnified side sectional view illustrating the cavity unit.

The same numbers of the first lead frames 100*a* and the second lead frames 100*b* as the number of necessary nozzles 11 are prepared, and an adhesive is previously applied (subjected to the application) to the wide width surfaces of the first lead frames 100*a* and the second lead frames 100*b* respectively. The first lead frames 100*a* and the second lead frames 100*b* are positioned, for example, by means of such a predetermined method that positioning pins (not shown) are inserted into positioning holes which are bored through the respective lead frames at a plurality of portions. The first lead frames 100*a* and the second lead frames 100*b* are alternately stacked, and they are adhered and joined by applying the pressure. Subsequently, when the obtained stack is punched out (cut out) along the portions of the boundary lines 10*a*, blocks of the cavity units 1 as shown in FIG. 2 are formed. Further, the end plates 22 are overlapped and joined onto the uppermost layer and the lowermost layer of the stack. Alternatively, third lead frames for constructing the end plates 22 may be stacked and joined onto the uppermost layer and the lowermost layer of the stack obtained by alternately stacking the first lead frames 100*a* and the second lead frames 100*b* to punch out the lead frames at once.

In the state shown in FIG. 2, the second plates 20 are positioned respectively in contact with the both front and back wide width surfaces (surfaces perpendicular to the direction of arrangement of the pressure chambers 12) of the first plates 10. Accordingly, the surfaces on the sides of the wide width surfaces of the openings 11*a* to form the nozzles 11, the openings 12*a* to form the pressure chambers 12, the openings 13*a* to form the ink supply flow passages 13, and the openings 15*a* to form the ink flow passages 15 are defined by the second plates 20 respectively.

Accordingly, the plurality of pressure chambers 12 are formed in a state of being comparted by the second plates 20 with the first surfaces being open on the first side in the stacking direction of the plates 10, 20. The nozzles 11 are formed while being open on the side opposite to the first side. The openings 14*a* and the openings 14*b* are communicated with each other in the array direction of the nozzles 11 to form the common ink chamber 14.

The both ends of the common ink chamber 14 are closed by the end plates 22, 22 to give the tightly closed state. Therefore, when the ink is supplied from an ink supply source such as an external ink tank to the cavity unit 1 by the aid of a tube or the like via an ink supply hole 23 provided through the side surface of the end plate 22, it is possible to supply the ink to the respective pressure chambers 12 and consequently to the respective nozzles 11 via the continuous portion formed by the openings 14*a* and the openings 14*b* (corresponding to the common ink chamber 14). The openings 14*a* and the openings 14*b* occupy the large areas on the wide width surfaces of the first plates 10 and the second plates 20. Therefore, even when any deviation arises to some extent during the alternate stacking operation for the first plates 10 and the second plates 20, the openings 14*a* and the openings 14*b*, which form the common ink chamber 14, are not closed as a whole. On the other hand, the nozzle 11, the ink supply flow passage 13, the pressure chamber 12, and the ink flow passage 15 are formed in one plate (first plate 10) in an integrated manner. Therefore, even when any positional deviation arises during the joining with the second plate 20, the flow of the ink is not obstructed thereby.

When release grooves (not shown) for the adhesive are previously formed on the wide width surfaces of the respective lead frames (plates), it is possible to prevent any excessive adhesive from inflowing into the nozzles 11, the ink supply flow passages 13, the pressure chambers 12, the ink flow passages 15, and the common ink chambers 14 to clog up the respective spaces disposed at portions especially having small cross-sectional areas (the nozzles 11, the ink supply flow passages 13, and the ink flow passages 15) by the adhesive.

In this embodiment, each of the first plate 10, the second plate 20, and the end plate 22 is made of 42% nickel alloy steel plate. The plate thicknesses of the first and second plates 10, 20 determine the spacing distances of arrangement of the nozzles 11 in the array direction, i.e., the dot spacing distances of the ink-jet brought about by the nozzles 11. For example, when each of the plate thicknesses of the first and second plates 10, 20 is 169 $\mu$m, the plate thickness corresponds to the ink-jet dot spacing distances of 75 individuals per 1 inch (25.4 mm).

When the openings 11*a*, 12*a*, 13*a*, 14*a*, 15*a*, which form the nozzle 11, the ink supply flow passage 13, the pressure chamber 12, and the ink flow passage 15, are formed penetratingly through the first plate 10, the nozzle 11, the ink supply flow passage 13, and the ink flow passage 15 have the same width as that of the pressure chamber 12 in the plate thickness direction of the plate. In order to allow the nozzle 11, the ink supply flow passage 13, and the ink flow passage 15 to have widths smaller than the width of the pressure chamber 12, they are formed as recesses on the first plate 10, for example, by means of the half etching processing.

Figure 5:
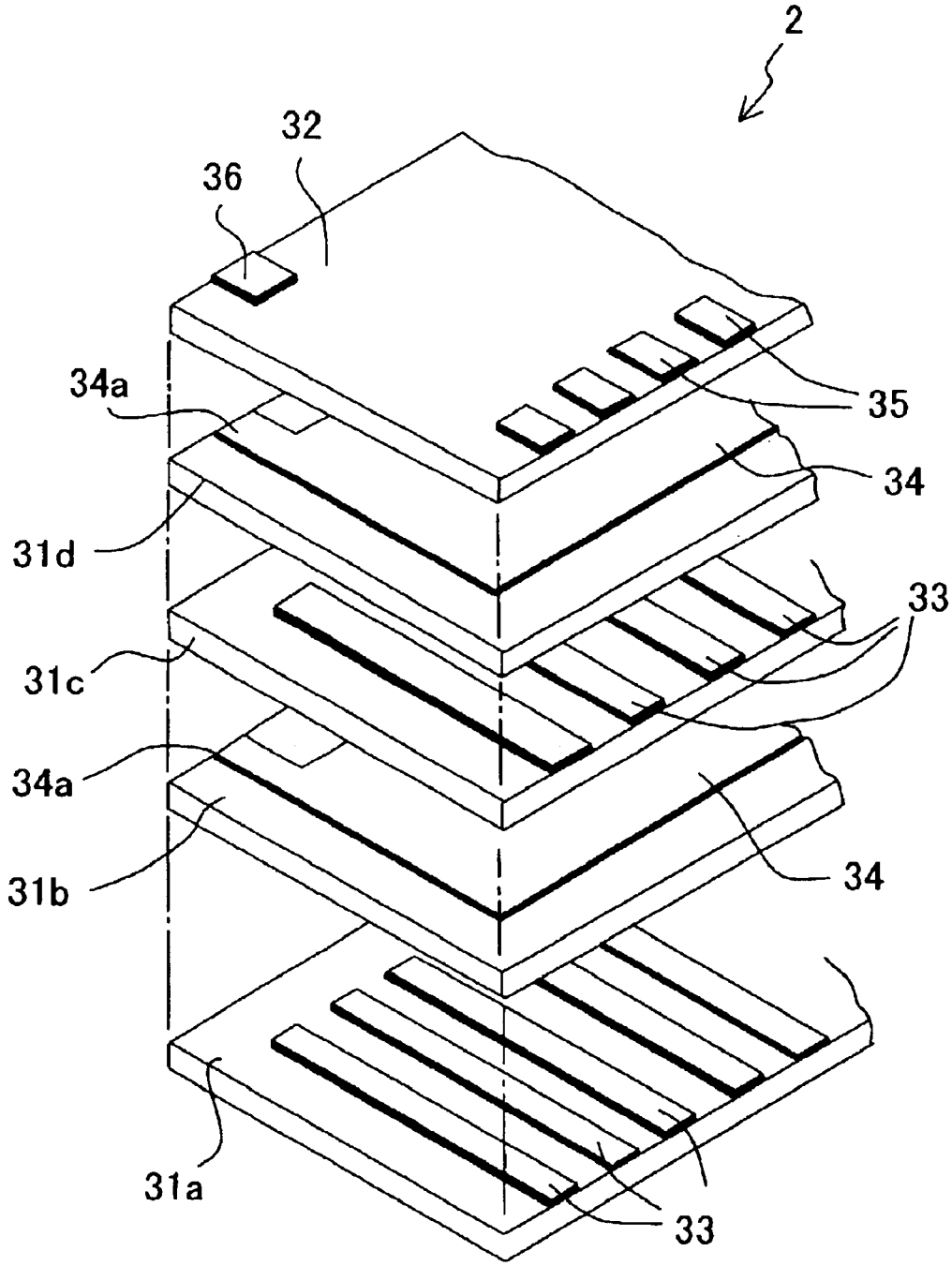
FIG. 5 shows an exploded perspective view illustrating a piezoelectric actuator.
Figure 6:
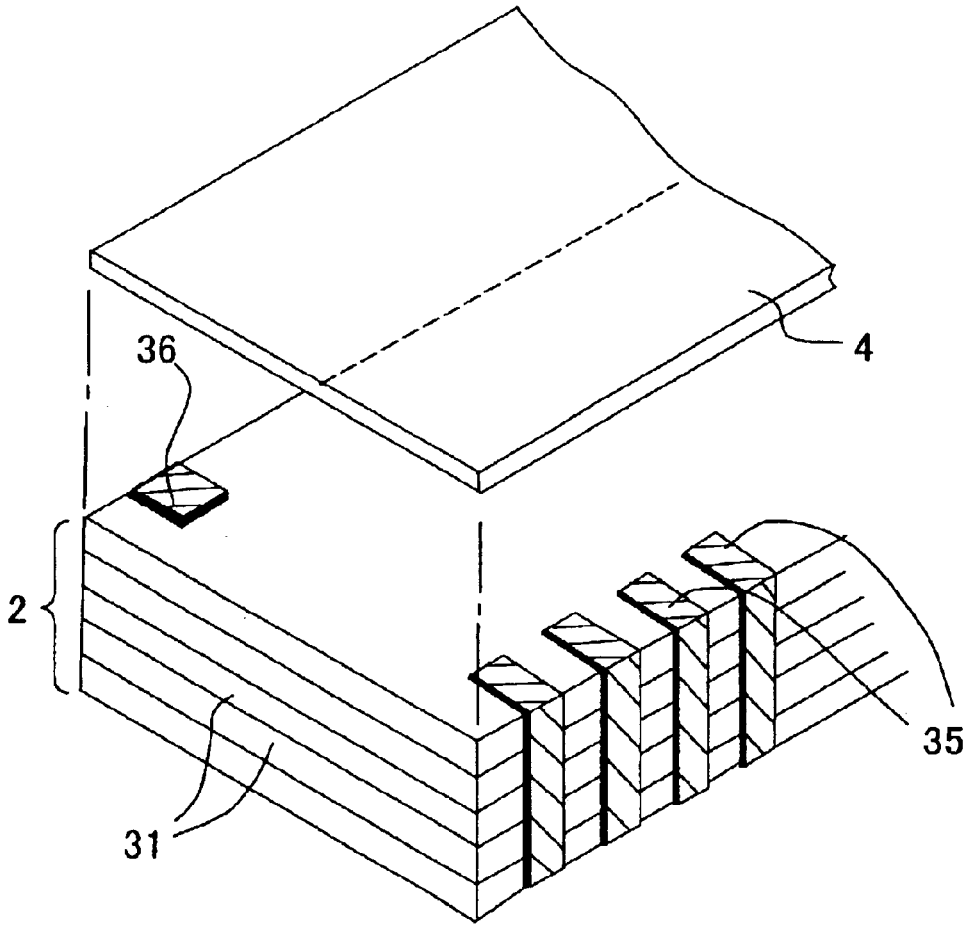
FIG. 6 shows a perspective view illustrating the piezoelectric actuator.

FIG. 5 shows an exploded perspective view illustrating the piezoelectric actuator 2, and FIG. 6 shows a perspective view illustrating the piezoelectric actuator 2 and the flexible flat cable 4. As shown in FIG. 5, the piezoelectric actuator 2 has a structure obtained by stacking a plurality of (four in this embodiment) piezoelectric sheets 31 (individually designated by reference numerals 31*a* to 31*d*) and a top sheet 32. Individual electrodes 33, which are thin in width, are formed in an array form in the array direction of the nozzles 11 (first direction, long side direction) at respective portions of the respective pressure chambers 12 of the cavity unit 1 on the upper surfaces (wide width surfaces) of the piezoelectric sheet 31*a* disposed at the lowermost level and the piezoelectric sheet 31*c* having the odd number as counted upwardly therefrom, of the respective piezoelectric sheets 31. The respective individual electrodes 33 extend in the second direction (short side direction) perpendicular to the first direction, and first ends of the respective individual electrodes 33 are exposed to the end edge of one of the long sides of each of the piezoelectric sheets 31. Each of common electrodes 34, which is common to the plurality of pressure chambers 11, is formed to have a large area on each of the upper surfaces (wide width surfaces) of the piezoelectric sheets 31*b*, 31*d* disposed at the even number levels as counted from the bottom so that the common electrodes 34 are overlapped with all of the individual electrodes 33 as viewed in plan view. A partial lead section 34*a* of the common electrode 34 extends in the direction opposite to the direction in which the first ends of the individual electrodes 33 extend. The partial lead section 34*a* of the common electrode 34 is exposed to the end edge of the other long side of the piezoelectric sheet 31. In this embodiment, the widthwise size of each of the individual electrodes 33 is formed to be slightly smaller than the widthwise size of the corresponding pressure chamber 12.

On the other hand, as shown in FIG. 5, surface electrodes 35 for the respective individual electrodes 33 and a surface electrode 36 for the common electrodes 34 are formed by the printing respectively on the upper surface of the top sheet 32 disposed at the uppermost level along the end edges of the long sides thereof.

Connecting side electrodes are applied so that the exposed portions of the individual electrodes 33, which are disposed at the same positions in the vertical direction of the piezoelectric sheets 31 of the piezoelectric actuator 2, are electrically connected to the surface electrodes 35 formed on the top sheet 32. Similarly, a connecting side electrode is applied so that the exposed portions (lead sections 34*a*) of the common electrodes 34 of the piezoelectric sheets 31 are electrically connected to the surface electrode 36 formed on the top sheet 32 (see FIG. 6).

An adhesive sheet 37 to serve as an adhesive layer, which is composed of a synthetic resin material having the ink-impermeability and the electric insulation, is previously stuck to the entire lower surface (wide width surface opposed to the pressure chambers 12) of the plate-shaped piezoelectric actuator 2 constructed as described above (see FIG. 3). Subsequently, the piezoelectric actuator 2 is adhered and fixed to the cavity unit 1 so that the respective individual electrodes 33 of the piezoelectric actuator 2 correspond to the respective pressure chambers 12 of the cavity unit 1.

Further, the flexible flat cable 4 is overlapped and joined to the upper surface of the piezoelectric actuator 2. Accordingly, various wiring patterns (not shown) of the flexible flat cable 4 are electrically jointed to the respective surface electrodes 35, 36.

In the structure constructed as described above, the piezoelectric sheet 31, which is disposed between the common electrode 34 and an arbitrary individual electrode 33 of the respective individual electrodes of the piezoelectric actuator 2, serves as the activating section 38 of the piezoelectric element in which the strain is generated in the stacking direction in accordance with the piezoelectric action when the voltage is selectively applied (see FIG. 2). When the internal volume of the pressure chamber 12 corresponding to the selected individual electrode 33 is reduced by the strain of the activating section 38, the ink contained in the pressure chamber 12 is jetted in a droplet form from the nozzle 11 to perform the predetermined printing.

Figure 7:
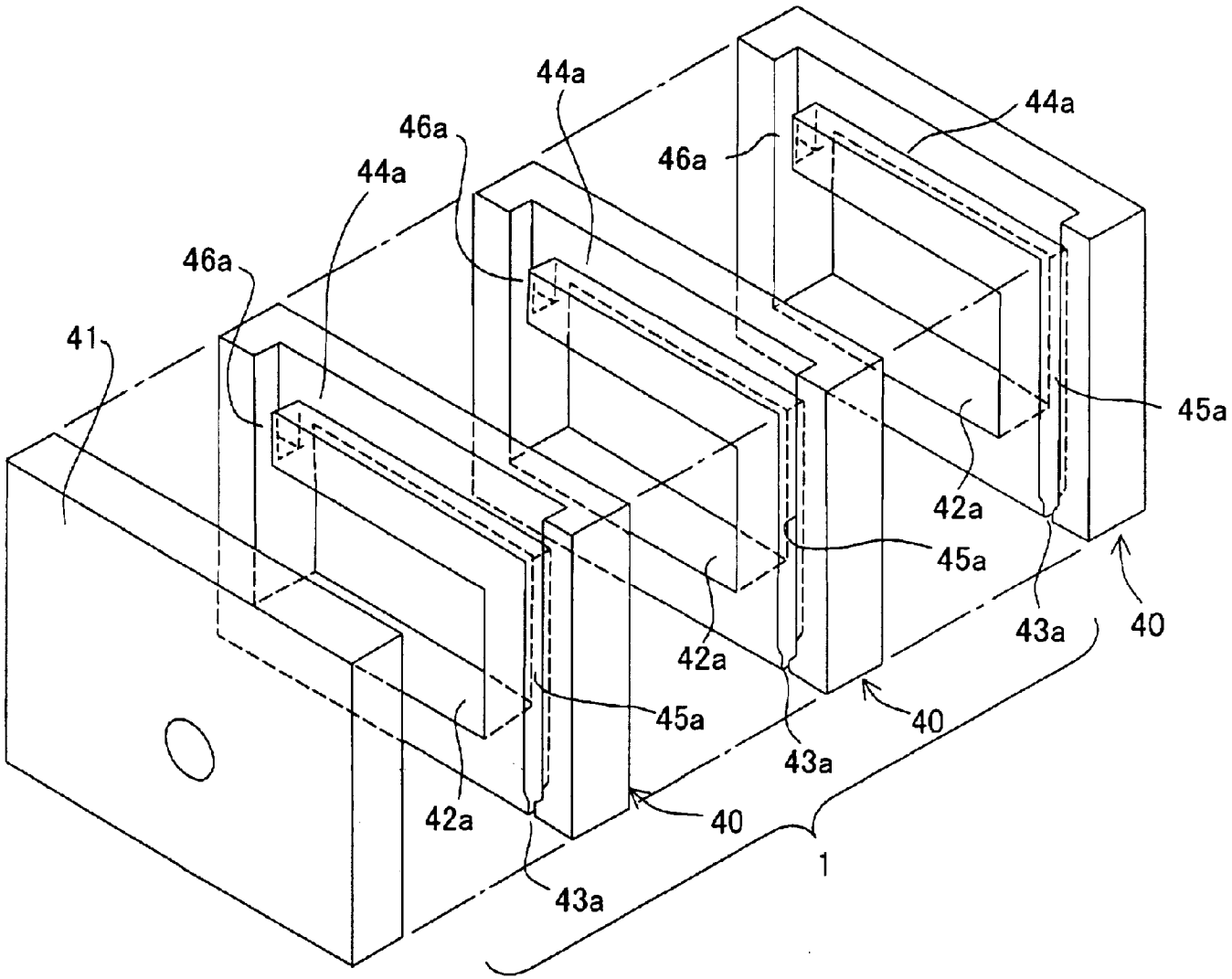
FIG. 7 shows a perspective view illustrating shapes of respective openings of plates according to a second embodiment.
Figure 8:
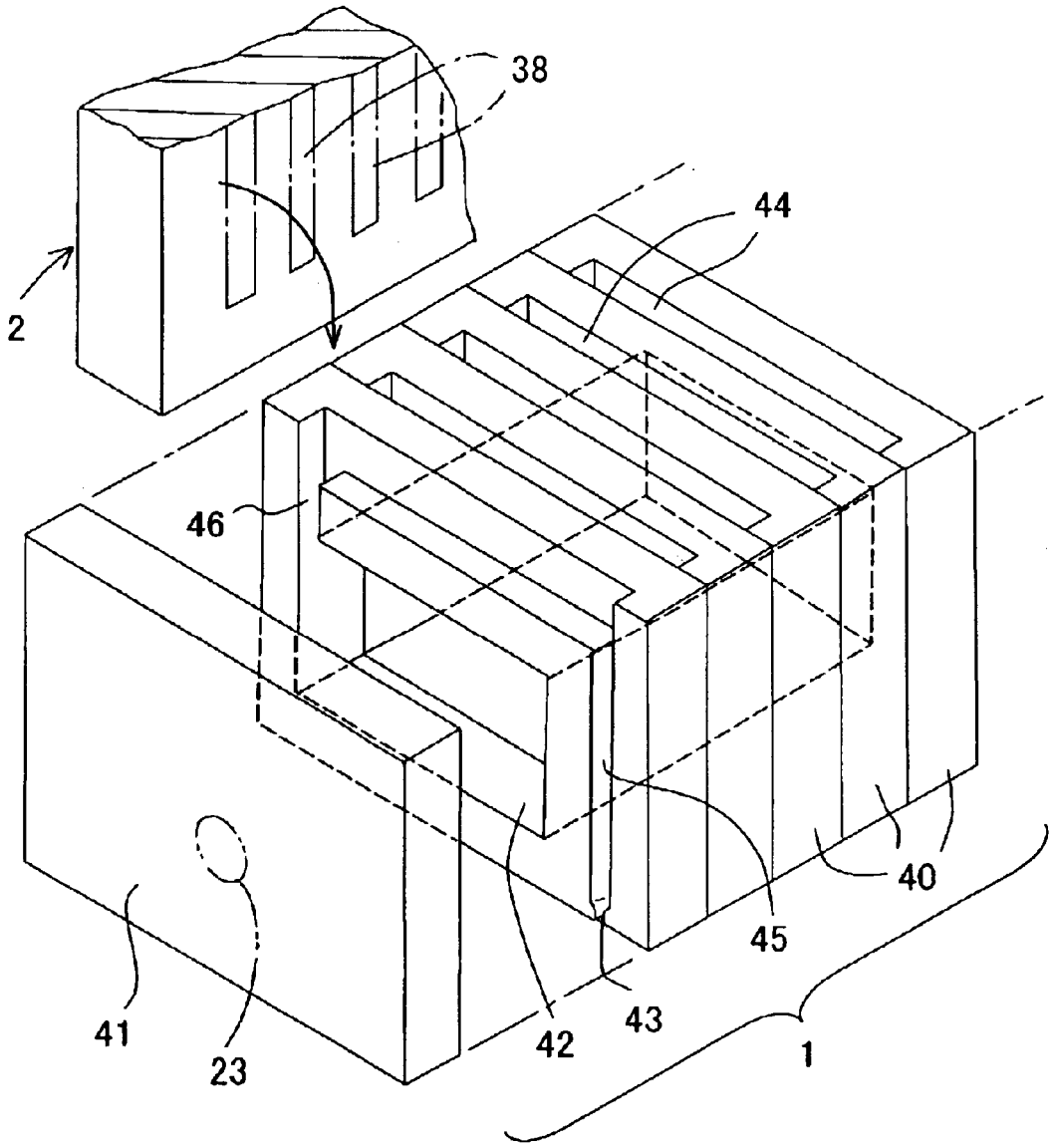
FIG. 8 shows a cavity unit constructed by stacking the first plates according to the second embodiment.

A second embodiment is shown in FIGS. 7 and 8. This embodiment is constructed such that a large number of (group of) first plates 40 having identical shapes are stacked, and the both ends of the stack are sealed with end plates 41. Openings 42*a*, which form a common ink chamber 42, are formed penetratingly through the wide width surfaces of the respective first plates 40 in the plate thickness direction. On the other hand, an opening 43*a* to form one nozzle 43, an opening 44*a* to form a pressure chamber 44, an opening 45*a* to form an ink supply flow passage 45 for making the communication between the pressure chamber 44 and the nozzle 43, and an opening 46*a* to form an ink flow passage 46 for making the communication from the common ink chamber 42 to the pressure chamber 44 are formed as recesses on each of the first plates 40 in the plate thickness direction on the wide width surface of the first plate 40.

The respective first plates 40 are stacked and joined at their wide width surfaces so that the openings 42*a* to form the common ink chamber 42 are communicated with each other. The wide width surfaces, which are disposed at the both ends of the group of the first plates 40 stacked as described above, are sealed with the end plates 41. Accordingly, the open surfaces of the openings 43*a*, 45*a*, 44*a*, 46*a* disposed on the sides of the wide width surfaces and formed as the recesses on the first surfaces (wide width surfaces) of the first plates 40 disposed on the first sides are closed and defined by the back surfaces of the first plates 40 disposed on the second sides to make the abutment against the wide width surfaces. Thus, the nozzles 43, the ink supply flow passages 45, the pressure chambers 44, and the ink flow passages 46 are formed. Also in this embodiment, the spacing distances of the arrangement of the nozzles 43 (dot spacing distances of the ink-jet) are regulated by the plate thickness of the first plate 40.

The piezoelectric actuator 2 is placed and joined with the adhesive sheet 37 having the ink-impermeability and the electric insulation intervening therebetween on the surface of the stack of the first plates 40 in the stacking direction, in which the plurality of pressure chambers 44 are open (exposed) on the surface, in the same manner as in the first embodiment described above. Substantially the same function and effect as those of the first embodiment are obtained in the second embodiment.

It is preferable that an ink supply hole 23 is provided through the end plate 41 in order to connect a pipe for supplying the ink from an external ink supply source.

Figure 9A:
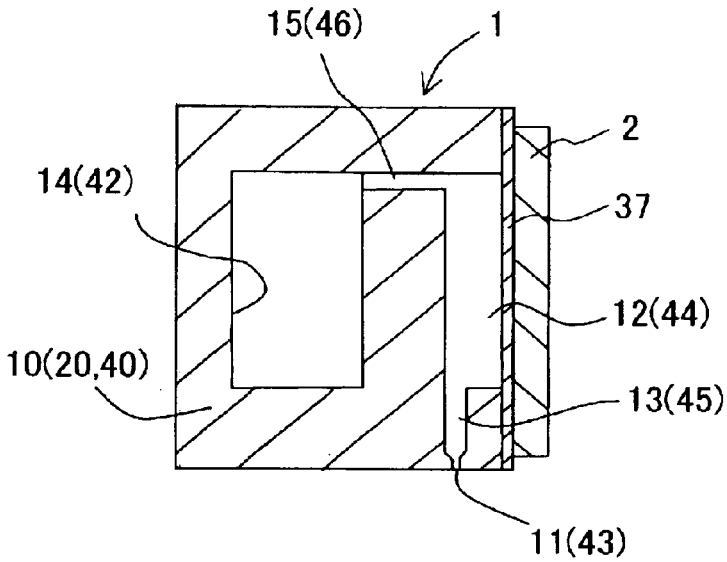
FIGS. 9A and 9B show modified embodiments of the arrangement of the respective openings of the cavity unit respectively.
Figure 9B:
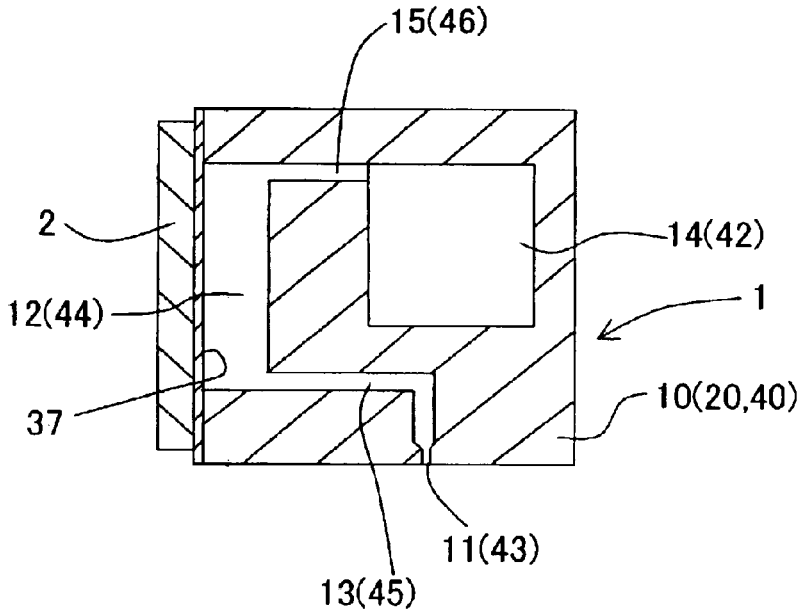

FIGS. 9A and 9B show modified embodiments of the arrangement pattern of the nozzle 11 (43), the ink supply flow passage 13 (45), the pressure chamber 12 (44), the ink flow passage 15 (46), and the common ink chamber 14 (42). In the modified embodiments, a portion of the pressure chamber 12 (44) is open (exposed) to the side of the side end surface which is perpendicular to the first side end surface to which the nozzle 11 (43) of the first plate 10 (40) is open. The portion is covered with the piezoelectric actuator 2.

Figure 10:
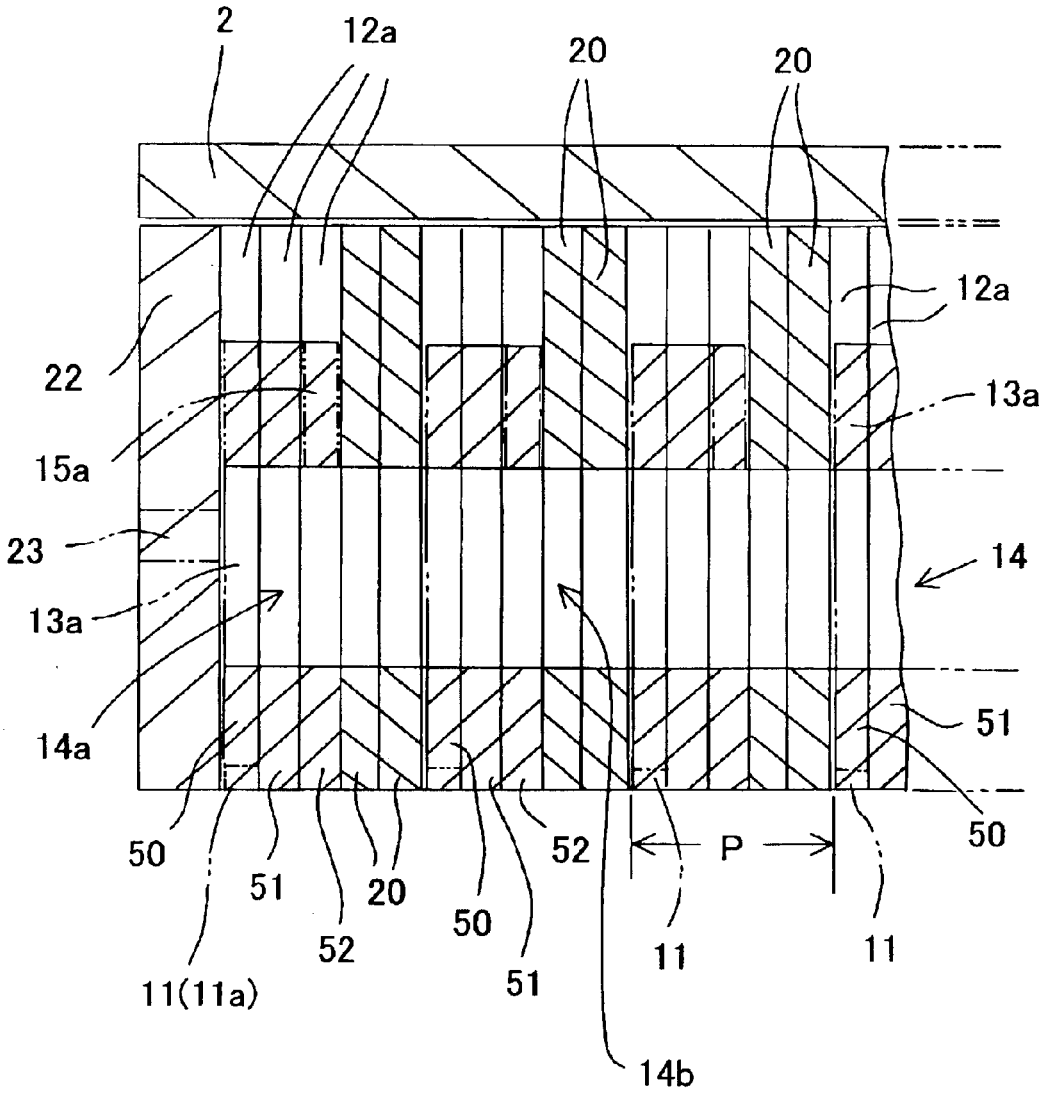
FIG. 10 shows a side sectional view illustrating an arrangement in which a cavity unit is constructed by staking a plurality of first plates and second plates.

In a third embodiment shown in FIG. 10, stacks, each of which is obtained by stacking a plurality of (two in this embodiment shown in FIG. 10) second plates 20 having only the openings 14*b*, are prepared. On the other hand, stacks are prepared, each of which is obtained by stacking three plates, i.e., a first plate 50 having the openings 11*a*, 13*a*, 12*a*, 14*a* formed penetratingly in the plate thickness direction, a first plate 51 having the openings 12*a*, 14*a* formed penetratingly in the plate thickness direction, and a first plate 52 having the openings 12*a*, 15*a*, 14*a* formed penetratingly in the plate thickness direction. The stacks are alternately stacked as shown in FIG. 10. Accordingly, the size of the pressure chamber 12 in the direction of arrangement of the pressure chambers corresponds to the total plate thickness of the three first plates 50, 51, 52. On the other hand, the nozzle 11 can be made small to have the widthwise size corresponding to the plate thickness of the first plate 50. Further, the spacing distances (pitches) P of the arrangement of the nozzles 11 in the direction of arrangement of the pressure chambers can be made to have the large pitch, i.e., the sum of the plate thicknesses of the three first plates 50, 51, 52 and the plate thicknesses of the two second plates 20. The ink supply flow passage 13 and the ink flow passage 15 can be made in discord as well in the direction of arrangement of the pressure chambers. In these cases, the plate thicknesses of the plurality of first plates 50 to 52 and the second plates 20 may be made identical. Alternatively, the respective plates may have different plate thicknesses.

In each of the embodiments described above, the portions of the first plate, at which the pressure chamber 12 (44) and the common ink chamber 14 (42) are connected to the ink supply flow passage 13 (45) and the ink flow passage 15 (46), may be formed to have arbitrary curves along the wide width surface of each of the plates. Accordingly, it is possible to decrease the turbulence of the flow at the portions at which the direction of the flow of the ink is changed, and it is possible to exhibit the stable jetting characteristics.

In each of the embodiments described above, a plurality of nozzles may be bored through one plate in the same manner as in the known ink-jet recording head, the nozzle plate may be adhered to the surface formed by the plates 10, 20 in the stacking direction, and the respective openings 11*a* may be communicated with the nozzles. In this arrangement, the ink supply flow passage 13 may be elongated up to the end edge of the plate 10.

As for the actuator in the present invention, an actuator such as a heat-generating element may be used without using the piezoelectric element.

What is claimed is:

1. An ink-jet recording head, comprising:

a cavity unit which has a plurality of nozzles, a plurality of pressure chambers which are communicated with the plurality of nozzles respectively and which are arranged in a direction, and a common ink chamber which extends in the direction of arrangement of the plurality of pressure chambers and which is communicated with the plurality of pressure chambers; and an actuator which deforms the respective pressure chambers, wherein:

the cavity unit includes a plurality of stacked plates, and each of the plates has a nozzle which constitutes the plurality of nozzles, a pressure chamber which is communicated with the nozzle and which constitutes the plurality of pressure chambers, and an opening which is communicated with the pressure chamber and which defines the common ink chamber, and the pressure chamber of each of the plates which constitute the cavity unit is open to a side to which the actuator is attached.

2. The ink-jet recording head according to claim 1, wherein the plurality of plates are stacked in the direction of arrangement of the pressure chambers.

3. The ink-jet recording head according to claim 1, wherein the common ink chamber extends in the direction of arrangement of the pressure chambers.

4. The ink-jet recording head according to claim 3, wherein the respective plates are first plates each having the pressure chamber and the opening which are formed penetratingly in a thickness direction of the plate, and the ink-jet recording head further comprises a plurality of second plates each having an opening which defines the common ink chamber and which is formed penetratingly in the thickness direction of the plate, the first plates and the second plates being alternately stacked so that the openings of the first plates and the openings of the second plates are communicated with each other.

5. The ink-jet recording head according to claim 4, wherein a part of the pressure chamber of the first plate is defined by the second plate.

6. The ink-jet recording head according to claim 4, wherein an ink supply flow passage which communicates the pressure chamber with the nozzle and an ink flow passage which communicates the pressure chamber with the opening are formed penetratingly through the plate in the thickness direction of the plate.

7. The ink-jet recording head according to claim 6, further comprising an end plate which seals at least an end of the common ink chamber, the end plate being disposed at an end surface of a stack constructed by the first plates and the second plates in a stacking direction.

8. The ink-jet recording head according to claim 1, wherein the each plate is provided with an ink supply flow passage which communicates the pressure chamber with the nozzle and an ink flow passage which communicates the pressure chamber with the opening, the opening is formed penetratingly in a thickness direction of the plate, and the pressure chamber, the ink supply flow passage, and the ink flow passage are formed as recesses in the thickness direction of the plate on a surface perpendicular to the direction of arrangement of the pressure chambers.

9. The ink-jet recording head according to claim 8, wherein a side portion of the pressure chamber of each of the plates is covered with the adjoining plate, and an upper portion of the pressure chamber of each of the plates is covered with the actuator.

10. The ink-jet recording head according to claim 1, wherein the actuator has a plurality of activating sections, an activating section selectively drivable for driving a corresponding pressure chamber, the plurality of activating sections arranged in parallel to the arrangement of the pressure chambers.

11. A method for producing an ink-jet recording head comprising a cavity unit which has a plurality of nozzles, a plurality of pressure chambers which are communicated with the plurality of nozzles respectively and which are arranged in a direction, and a common ink chamber which extends in the direction of arrangement of the plurality of pressure chambers and which is communicated with the plurality of pressure chambers; and an actuator which deforms the respective pressure chambers, the method comprising:

providing a plurality of plates each having a nozzle which constitutes the plurality of nozzles, a pressure chamber which is communicated with the nozzle and which constitutes the plurality of pressure chambers, and an opening which is communicated with the pressure chamber and which defines the common ink chamber;

assembling the cavity unit by stacking the plurality of plates so that the openings of the plurality of plates are communicated with each other in the direction of arrangement of the pressure chambers; and attaching the actuator to the cavity unit.

12. The method for producing the ink-jet recording head according to claim 11, wherein the respective plates are first plates each having the pressure chamber and the opening which are formed penetratingly in a thickness direction of the plate, and the first plates and second plates each having an opening which defines the common ink chamber and which is formed penetratingly in the thickness direction of the plate are alternately stacked so that the openings of the first plates and the openings of the second plates are communicated with each other.

13. The method for producing the ink-jet recording head according to claim 12, further comprising providing an end plate which seals at least an end of the common ink chamber, at an end surface of a stack constructed by the first plates and the second plates in a stacking direction.

14. The method for producing the ink-jet recording head according to claim 11, wherein a part of the pressure chamber of the first plate is defined by the second plate.

15. The method for producing the ink-jet recording head according to claim 11, wherein an ink supply flow passage which communicates the pressure chamber with the nozzle and an ink flow passage which communicates the pressure chamber with the opening are formed penetratingly through the plate in the thickness direction of the plate.

16. The method for producing the ink-jet recording head according to claim 11, wherein the plate is provided with an ink supply flow passage which communicates the pressure chamber with the nozzle and an ink flow passage which communicates the pressure chamber with the opening, the opening is formed penetratingly in a thickness direction of the plate, and the pressure chamber, the ink supply flow passage, and the ink flow passage are formed as recesses in the thickness direction of the plate on a surface perpendicular to the direction of arrangement of the pressure chambers.

17. The method for producing the ink-jet recording head according to claim 16, wherein the plurality of plates are stacked so that a side portion of the pressure chamber of each of the plates is covered with the adjoining plate, and the actuator is attached to the cavity unit so that an upper portion of the pressure chamber of each of the plates is covered with the actuator.

* * * * *